US007395946B2

(12) United States Patent
Yuyama et al.

(10) Patent No.: US 7,395,946 B2
(45) Date of Patent: Jul. 8, 2008

(54) TABLET CASSETTE

(75) Inventors: Shoji Yuyama, Toyonaka (JP); Shuichi Inoue, Toyonaka (JP); Masaru Kinoshita, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 79 days.

(21) Appl. No.: 10/574,075

(22) PCT Filed: Sep. 21, 2004

(86) PCT No.: PCT/JP2004/013738

§ 371 (c)(1),
(2), (4) Date: Mar. 30, 2006

(87) PCT Pub. No.: WO2005/032944

PCT Pub. Date: Apr. 14, 2005

(65) Prior Publication Data

US 2007/0116792 A1 May 24, 2007

(30) Foreign Application Priority Data

Oct. 1, 2003 (JP) ..... 2003-343427

(51) Int. Cl.
*B65H 3/00* (2006.01)

(52) U.S. Cl. ..... 221/265; 221/263; 221/264; 221/186; 221/188; 221/189

(58) Field of Classification Search ..... 221/1–312 C; 700/231–244
See application file for complete search history.

(56) References Cited

U.S. PATENT DOCUMENTS 6,367,232 B2 * 4/2002 Kim ..... 53/507
6,394,308 B1 * 5/2002 Yuyama et al. ..... 221/265
6,585,132 B2 * 7/2003 Kim ..... 221/133
7,131,554 B2 * 11/2006 Hashimoto ..... 221/197
2002/0007868 A1 * 1/2002 Kodama et al. ..... 141/104

FOREIGN PATENT DOCUMENTS

| | | |
|---|---|---|
| CN | 2235756 | 9/1996 |
| JP | 9-30501 | 2/1997 |
| JP | 9-323702 | 12/1997 |
| JP | 10-314277 | 12/1998 |
| JP | 2002-179020 | 6/2002 |
| JP | 2002-186658 | 7/2002 |

OTHER PUBLICATIONS

Chinese Office Action (In English language) issued Feb. 22, 2008.

* cited by examiner

*Primary Examiner*—Gene O. Crawford
*Assistant Examiner*—Michael K Collins
(74) *Attorney, Agent, or Firm*—Wenderoth, Lind & Ponack, L.L.P.

(57) ABSTRACT

A tablet cassette in which a tablet is not discharged during a mounting or dismounting operation of the tablet cassette. The tablet cassette (1) incorporates a rotor (6) having pocket portions (7) for holding tablets (T). When the tablet cassette 1 is mounted on a mount base (2), rotation of the rotor (6) causes the tablets (T) held in the pocket portions (7) to be discharged though a discharge port (8). The tablet cassette (1) includes a press member (16) which is pressed when the tablet cassette (1) is mounted on the mount base (2) and a rotor reversing member (19) for reversing the rotor (6) by a predetermined quantity in conjunction with pressing of the press member (16).

11 Claims, 11 Drawing Sheets

TABLET CASSETTE

BACKGROUND OF THE INVENTION

1. Technical Field

The present invention relate to a tablet cassette to be mounted on a tablet packing apparatus in which tablets are dispensed and packed in accordance with a prescription of a patient.

2. Description of Related Art

Conventionally, in a tablet packing apparatus, a plurality of tablet feeders are provided for every kind of tablets. Each tablet feeder comprises a tablet cassette for containing a number of tablets and a mount base on which the tablet cassette is mounted. The tablet cassette has a rotor. The outer surface of the rotor is formed with a plurality of pocket portions, each of which comprises a groove extending in an axial direction so as to hold the tablets. On the shaft of the rotor protruding downward from the bottom of the tablet cassette, a rotor gear is attached. On the bottom of the tablet cassette is attached an intermediate gear which engages with the rotor gear. In the rear portion of the bottom of tablet cassette is formed a discharge port which communicates with the pocket portions of the rotor. On the other hand, a motor is incorporated in the mount base. The shaft of the motor protrudes upward. A drive gear is fixed on the upper end of the shaft. When the tablet cassette is mounted on the mount base, the intermediate gear of the tablet cassette engages with the drive gear of the mount base. Driving the motor allows the rotor to rotate via the drive gear, the intermediate gear and the rotor gear. When the pocket portion reaches the discharge port, the tablet held in the pocket portion is discharged thorough the discharge portion and led to a packing unit though a discharge path in the mount base. When the tablet cassette is dismounted or removed from the mount base for replenishment of the tablet or inspection, the intermediate gear of the tablet cassette is disengaged from the drive gear of the mount base, thereby allowing the rotor to freely rotate. Thus, there has been a possibility that the rotor will unexpectedly rotate due to impact or vibration to cause the tablet held in the pocket of the rotor to drop from the discharge port into the packing unit, resulting in the tablet being packed in a state contaminated by other tablets.

Conventionally, there have been various suggestions for preventing the rotor from unexpectedly rotating when mounting and dismounting the tablet cassette. For example, JP 9-30501A discloses a restraint means for engaging with a gear of a rotor due to its elasticity to restrain self-rotation of the rotor when a tablet cassette is dismounted. The document also discloses a release means for releasing the engagement of the restraint means with the rotor when the tablet cassette is mounted.

The JP 9-323702A, which was filed by the same applicant as the present application, discloses an elastic engagement member that engages with a gear of a rotor to prevent the rotation of the rotor when a tablet cassette is dismounted, and an engagement release member provided on the elastic engagement member that comes into press contact with a proper position of a guide rail of a mount base to release the engagement of the elastic engagement member with the gear when the tablet cassette is mounted.

JP 10-314277A discloses an engagement means that directly engages with and disengages from a rotor so that the engagement means engages with a peripheral wall of a rotor when a tablet cassette is dismounted and disengaged from the rotor when the cassette is mounted.

SUMMARY OF THE INVENTION

However, because the systems disclosed in above patent documents prevent rotation of the rotor as the tablet cassette is drawn from or pushed in the mount base, there is a time point that the rotor can freely rotate during a mounting or dismounting operation of the tablet cassette. For a period after starting operation to dismount the tablet cassette from the mount base until, for example, the restraint means of JP 9-30501A operates, or a period after releasing the engagement of, for example, the restraint means with the rotor during the operation of mounting the tablet cassette on the mount base until the tablet cassette is completely mounted, the rotor can be freely rotated. Thus, there has been a possibility that the rotor will rotate due to impact, causing the tablet held in the pocket portion of the rotor to appear in the discharge port and be discharged.

The present invention is made in consideration of the above-described problems. It is an object of the present invention to provide a tablet cassette in which the tablet is not discharged during an operation to mount or dismount the tablet cassette.

In order to solve the above object, the present invention provides a tablet cassette for containing a number of tablets. The tablet cassette incorporates a rotor having pocket portions for holding the tablets. When the tablet cassette is mounted on a mount base, rotation of the rotor causes the tablets held in the pocket portions to be discharged though a discharge port. The tablet cassette comprises a press member which is pressed when the tablet cassette is mounted on the mount base, and a rotor reversing member for reversing the rotor by a predetermined quantity in conjunction with press of the press member.

In the above construction of the present invention, when a user presses the press portion in order to mount or dismount the tablet cassette, the rotor reversing member reverses the rotor by a predetermined quantity in conjunction with this pressing action. Thus, the tablet that has appeared in the discharge port of the tablet cassette returns to inside of the tablet case and no longer appears in the discharge port. As a result, when mounting or dismounting operation of the tablet cassette is conducted as the press member is pressed, the tablet is never discharged due to vibration or impact.

Preferably, the press member is a press lever that is rotatably provided on the tablet cassette. Instead of a press lever, a press button and such is also available. In other words, a member that is necessarily pressed when a user mounts or dismounts the tablet cassette with respect to the mount base is preferable.

Preferably, the press member comprises a resilient piece extending from the support shaft to the opposite side to the press lever, and the resilient piece comprises an engagement claw for engaging with and disengaging from an engaged portion of a guide rail provided on the mount base. Thus, the engagement claw disengages from the engaged portion of the guide rail when the press member is pressed, and the engagement claw engages with the engaged portion of the guide rail when pressing of the press member is stopped, thereby enabling mounting or dismounting of the tablet cassette smoothly without causing a vibration and impact.

Preferably, the press member comprises a pair of members which is pressed at the same time when the tablet cassette is held. Thus, it is possible to press the press member with only one action and hold the tablet cassette when mounting and dismounting the tablet cassette.

Preferably, the rotor reversing member is provided on any one of the pair of press members. It is also preferable that the tablet cassette further comprises a biasing member for biasing the press member in a non-pressing direction.

Preferably, the rotor reversing member is an arm extending from the press member, the extremity of the arm is obliquely opposed to teeth of a rotor gear fixed on a shaft of the rotor which protrudes from the bottom of the tablet cassette. The phrase "the extremity of the arm is obliquely opposed to teeth of a rotor gear" means that the pivot excursion of the extremity of the arm can obliquely intersect with the addendum circle of the rotor gear. In this construction, when the press member is pressed, the extremity of the arm engages with the teeth of the rotor gear to reverse the rotor gear. The amount of reverse rotation may be about one pitch of the rotor gear or a length less than the distance between the pocket portions of the rotor.

Preferably, a contact member is provided in the vicinity of the rotor gear so that the distance to the rotor gear can be adjusted, and wherein a portion close to the extremity of the arm comes into contact with the contact member so that the extremity of the arm can enter into a space between the contact member and the rotor gear when the press member is pressed. Thus, with the distance between the contact member and the rotor gear adjusted, the amount that the extremity of the arm enters between the contact surface and the rotor gear when the press member is pressed can be adjusted and also the reverse amount of the rotor gear can be adjusted.

In this case, it is preferable that a flexible portion is provided in at least one part of the arm. As the "flexible portion", a thin-walled portion formed in a part of the arm, a leaf spring constituting the whole arm or a part of the arm, or a torsion spring attached on the extremity or intermediate portion of the arm can be adopted. According to this construction, when the extremity of the arm engages with the teeth of the rotor gear, further pivot of the arm causes the flexible portion of the arm to deform. Therefore, even in the case where the amount of reverse movement of the rotor gear, i.e. the movement amount of the arm is reduced, the press portions can be sufficiently pressed, making it easy to operate the press portion.

Preferably, the tablet cassette further comprises a rotation restraint gear which moves in conjunction with the pressing of the press member and engages with the rotor gear to restrain the rotor gear from rotating at a torque less than a predetermined level. According to this construction, when the press member is pressed, the rotation restraint gear moves to engage with the rotor gear. However, if a torque more than a predetermined level is exerted on the rotor gear via the rotor reversing member when pressing the press member, the rotor gear can be reversed. When pressing the press member is stopped and the rotor reversing member returns to an initial position, the torque is less than the predetermined level, preventing the rotor gear once reversed from returning in a forward rotation direction.

Preferably, the rotation restraint gear is movable in a tangential direction of the rotor gear. In this mechanism, when the rotor gear rotates in a reverse direction, engagement of the rotor gear with the rotation restraint gear is maintained, whereas when the rotor gear rotates in a forward direction, engagement of the rotor gear with the rotation restraint gear is released, thereby allowing the rotation restraint gear to move away from the rotor gear. Thus, even if the rotation restraint gear remains engaged with the rotor gear when pressing of the press member is stopped, forward rotation of the rotor when discharging the tablets allows the rotation restraint gear to disengage from the rotor gear. Therefore, a mechanism for disengaging the rotation restraint gear from the rotor gear is not necessary.

According to the present invention, as the tablet cassette comprises a press member which is pressed when the tablet cassette is mounted on the mount base and a rotor reversing member for reversing the rotor by a predetermined quantity in conjunction with press of the press member, the tablet that has appeared in the discharge port of the tablet cassette returns to the interior of the tablet cassette from the discharge port. As a result, the tablet is never discharged due to vibration or impact, and admixing of the tablets is prevented.

EXPLANATION OF THE REFERENCE NUMERALS

Figure 1:
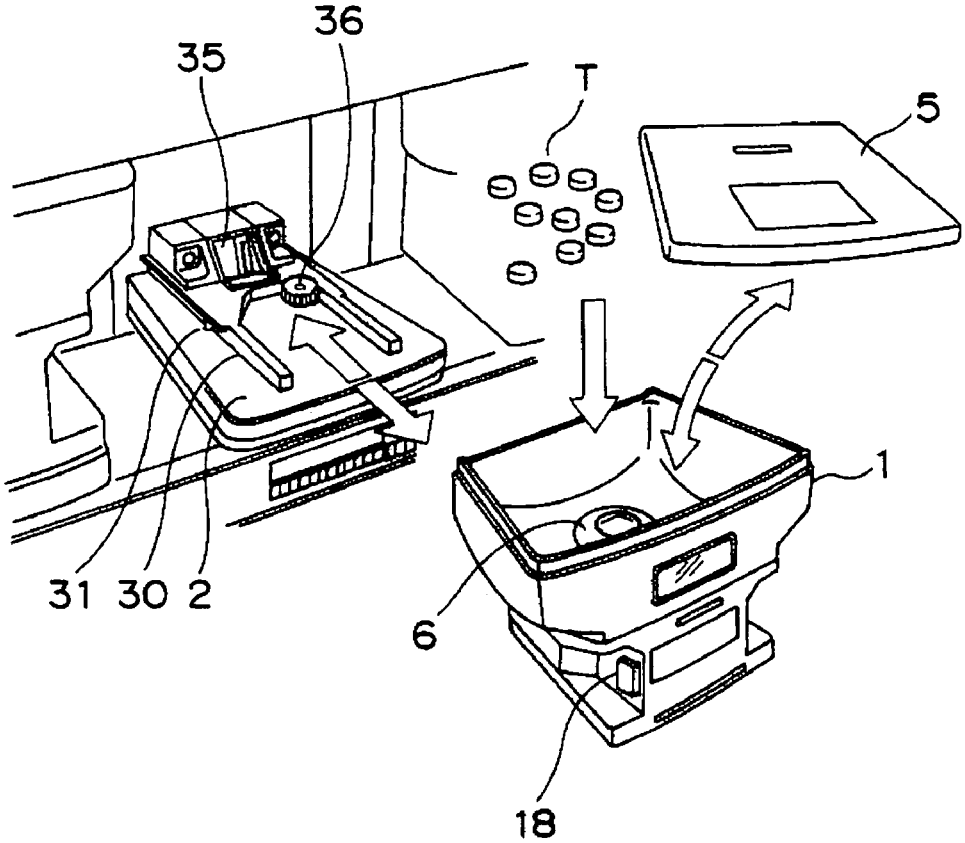
FIG. 1 is a perspective view of a tablet cassette and a mount base.

1 tablet cassette
2 mount base
6 rotor
7 pocket portion
8 discharge port
11 rotor gear
13 first lever
14 second lever
16 press lever (Press member)
17 resilient piece
19 arm (rotor reversing member)
20 thin-walled portion (flexible portion)
21 engagement claw
23 leaf spring (biasing member)
31 engaged portion
36 rotation restraint gear

DETAILED DESCRIPTION OF THE INVENTION

Hereinafter, embodiments of the present invention will be described with reference to the accompanied drawings.

First Embodiment

Figure 2:
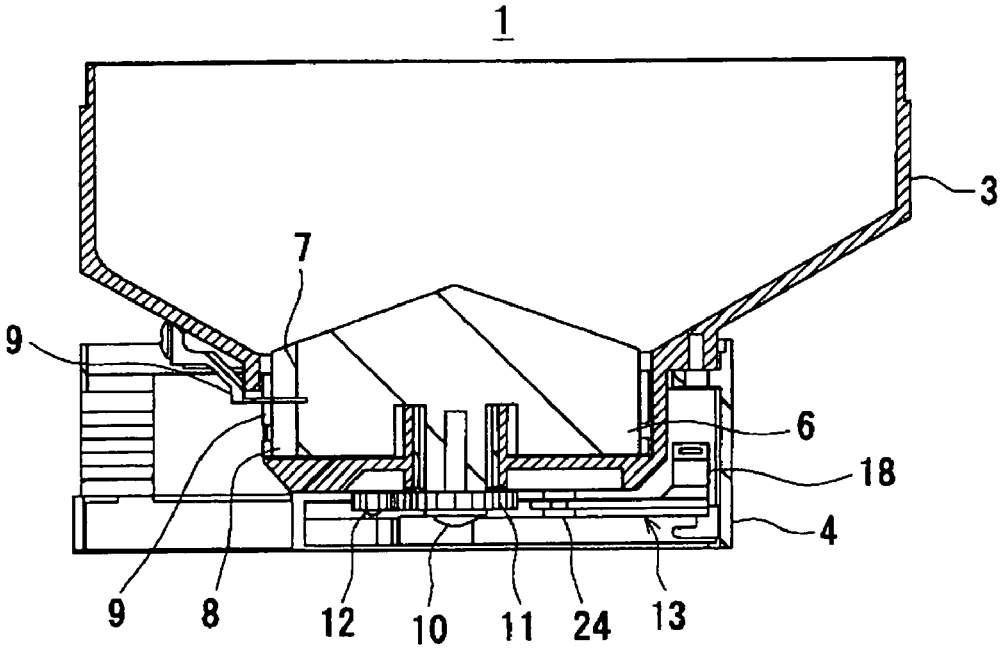
FIG. 2 is a sectional view of the tablet cassette.

FIG. 1 shows a tablet cassette 1 and a mount base 2 according to a first embodiment of the present invention. The tablet cassette 1 as shown in FIG. 2 comprises a case 3 made of synthetic resin and a support portion 4 incorporated with the case 3 and made of synthetic resin. A number of tablets T are contained in the case 3. The open end of the case 3 can be opened and closed by a cover plate 5. In the case 3, as shown in FIG. 1, a rotor 6 made of synthetic resin is disposed. The rotor 6, as shown in FIG. 2, has a top surface of conical shape. On the outer surface of the rotor 6, a plurality of pocket portions 7 extending in an axial direction are formed at a plurality of positions that are equal angularly spaced. Each pocket portion 7 has a width and a depth that allows it to hold only one tablet T and has a length (height) that allows it to hold one or more tablets T. A discharge port 8 is formed in the lower part of the case 3. The discharge port has a width that permits positioning of only one pocket portion 7 of the rotor 6. Above the discharge port 8 is attached a partition member 9 made of brush which enters the pocket portion 7 coming to the discharge port 8 and partitions the pocket portion 7 into upper and lower parts to separate the tablet T situated at the lowermost position in the pocket portion 7 from the tablet T situated above the same. The rotation shaft 10 of the rotor 6 protrudes from the lower surface of the bottom wall of the case 3 and supports a rotor gear 11. On the lower surface of the bottom wall of the case 3, an intermediate gear 12 which engages with the rotor gear 11 is rotatably provided.

Figure 4:
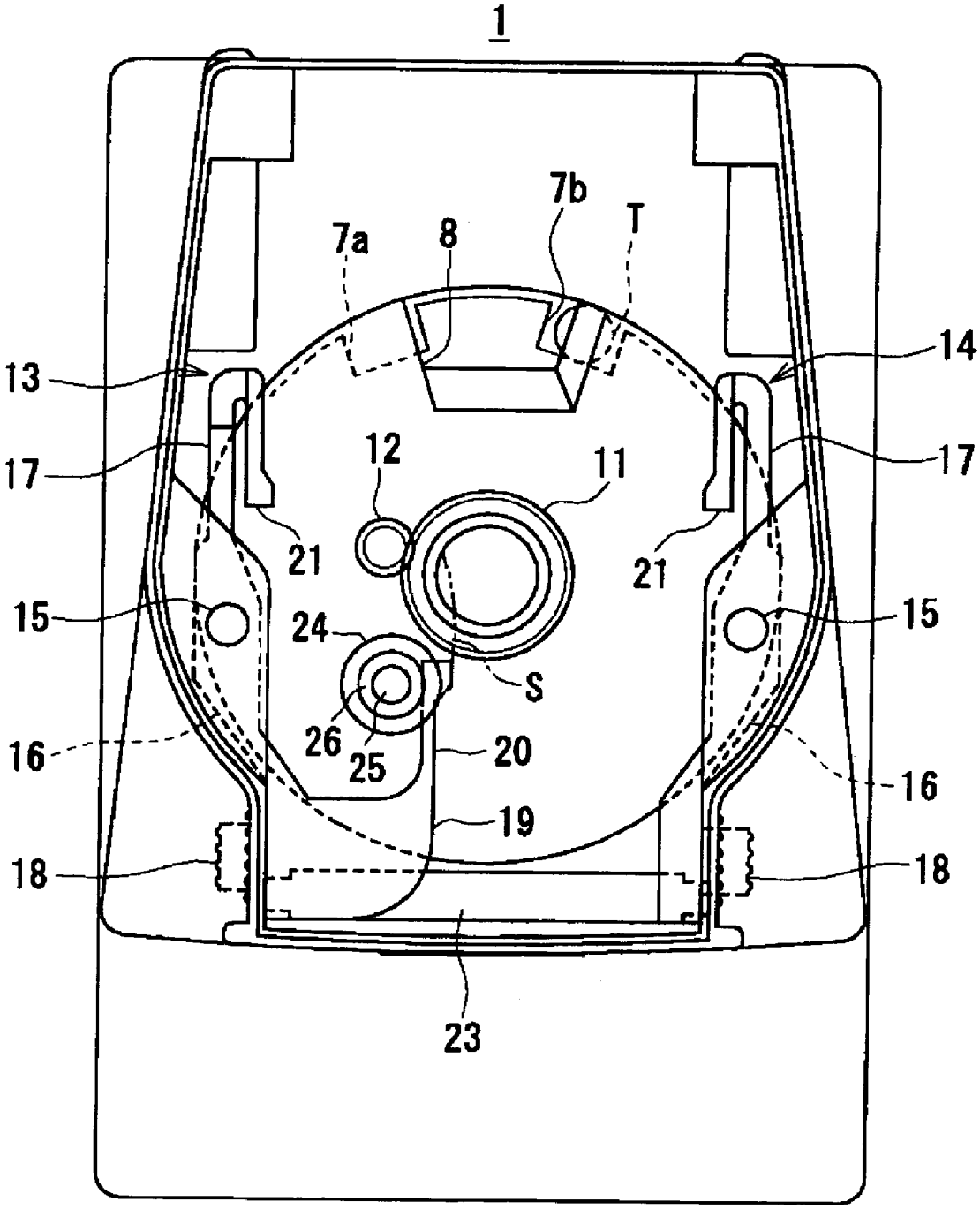
FIG. 4 is a bottom view showing a tablet cassette of a first embodiment according to the present invention in a non-pressing state of a press lever.
Figure 6:
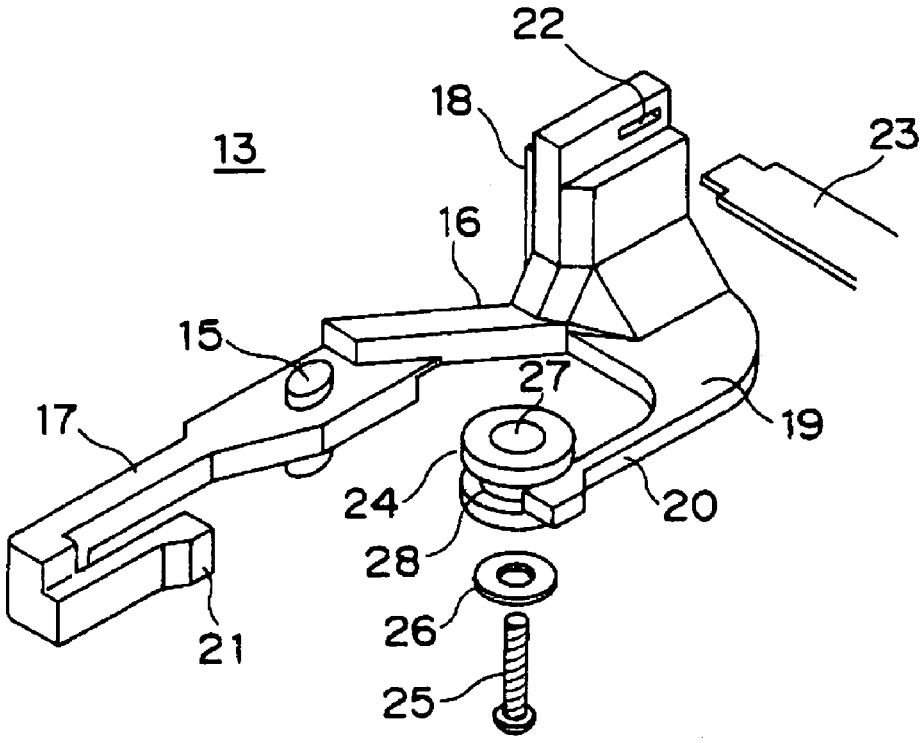
FIG. 6 is a perspective view of a first lever.
Figure 7:
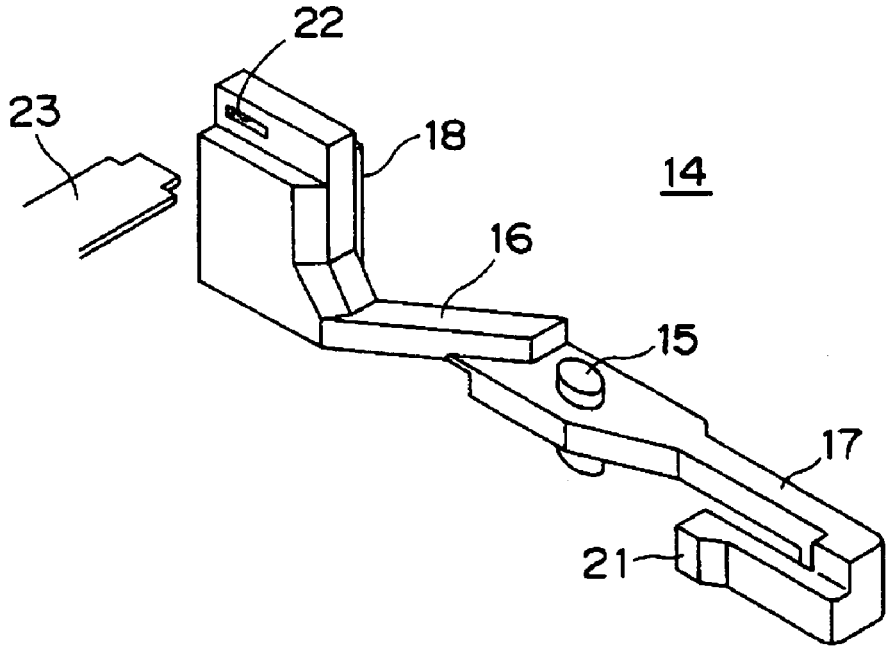
FIG. 7 is a perspective view of a second lever.

The support portion 4 is formed in a U-shape looking from the bottom of the case 3 as shown in FIG. 4. Inside the support portion, a first lever 13 and a second lever 14 are provided on both side of the rotor gear 11. The first lever 13 is integrally constructed of three members, i.e., a press member, a rotor reverse preventing member and a resilient piece. The first lever 13 is attached on the outer bottom surface of the tablet cassette 1 by means of support shaft 15 as shown in FIGS. 4 and 6. The press lever 16 is provided to extend in a dismounting direction of the tablet cassette 1 from the support shaft 15. The resilient piece 17 is provided in a reverse, i.e., mounting direction. On the outside of the extremity of the press lever 16, a press portion 18 is provided while on the inside an arm 19 is extended. The arm 19 extends at right angles from the extremity of the press lever 16, turns at 90 degrees to extend in a substantially parallel direction relative to the press lever 16 so that the extremity is positioned in the vicinity of the rotor gear 11. Thus, the press lever 16 and the arm 19 assume a substantially U-shape as viewed from the bottom surface of the tablet cassette 1. The extremity of the arm 19 obliquely faces the teeth of the rotor gear 11. That is to say, the arm 19 is opposed to the rotor gear so that the pivot excursion S of the extremity of the arm 19 as shown in one-dot chain line in FIG. 4 can obliquely intersect with the addendum circle of the rotor gear 11. A thin-walled portion 20 is formed in the vicinity of the extremity of the arm 19. On the other hand, the resilient piece 17 is bent in a U-shape and the extremity thereof is formed with an engagement claw 21. The second lever 14 has a symmetrical shape to the first lever 13 except having no arm 19 of the first lever 13.

The first lever 13 and the second lever 14 are biased in a direction that the press portions 18 are separated from each other by a leaf spring 23 made of synthetic resin. Both ends of the leaf spring 23 engage with slits 22 formed in the press portions 18 of the press levers 16. On the bottom surface of the tablet cassette 1, as shown in FIG. 4, a contact member 24 having a cylindrical shape is attached by means of adjusting screw 25 and washer 26 so that the contact member 24 is positioned between the press lever 16 of the first lever 13 and the arm 19 and comes into contact with the side surface of the extremity of the arm 19. As shown in FIG. 6, a shaft hole 27 in which the adjusting screw 25 of the contact member 24 is formed larger than the adjusting screw 25 so that the distance between the contact member 24 and the rotor gear 11 can be adjusted. On the outer surface of the contact member 24 is formed a groove 28 into which the extremity of the arm 19 enters, thereby preventing the arm 19 from moving in a direction perpendicular to the bottom surface of the tablet cassette when operating the press lever 10.

Figure 3:
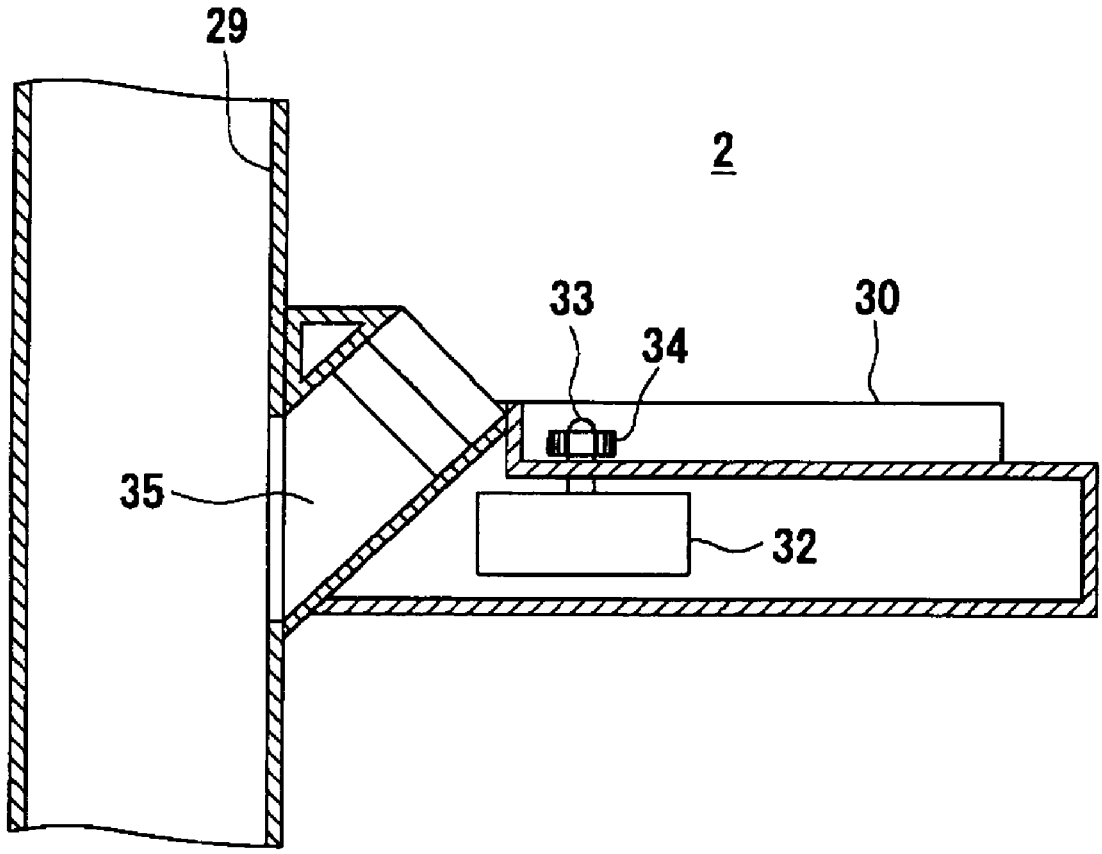
FIG. 3 is a sectional view of the mount base.

The mount base 2, as shown in FIG. 3, is formed in a shelf-like manner with one end of the mount base 2 fixed on the wall 29 of the tablet packing apparatus body. On the upper surface of the mount base 2, a pair of guide portions 30 is provided for guiding the support portion 4 of the tablet cassette 1. On the side surface of each of the pair of guide portions 30, an engaged portion 31 with which the engagement claw 21 of the resilient piece 17 of the tablet cassette 1 engages is formed. As shown in FIG. 3, a motor 32 which is controlled based on a control signal from a control unit (not shown) is incorporated in the mount base 2. The rotation shaft 33 of the motor 32 protrudes from the upper surface of the mount base 2 and is integrated with a drive gear 34 so that the intermediate gear 12 of the tablet cassette 12 engages with the drive gear 34 when the tablet cassette 1 is mounted. Further, the mount base 2 is formed with a tablet guide path 35 for guiding the tablet T discharged from the discharge port 8 of the tablet cassette 1 to a packing unit (not shown) and so on.

Operation of the tablet cassette 1 having above construction will be described hereinafter.

The tablet cassette 1 in which tablets T corresponding to the prescription data are contained can be driven in accordance with the prescription data. That is to say, the motor 32 of the mount base 2 is driven to rotate the rotor 6 of the tablet cassette 1 so that the tablets T held in the pocket portions 7 are discharged one after another through the discharge port 8 and the tablet guide path 35. A quantity of the discharged tablets T is counted by a sensor (not shown) provided in the tablet guide path 35. When the quantity of the discharged tablets T reaches a predetermined quantity, the motor 32 is stopped. At this time, an empty pocket portion 7, from which the tablet T is discharged, is positioned at the discharged port 8. However, as shown in FIG. 4, there are times when the rotor 6 moves due to rotational inertia, and causes the empty pocket portion 7*a* to hide from the discharge port 8 and a part of the tablet T held in the next pocket portion 7*b* to appear in the discharge port 8. The tablets T that are discharged via the tablet guide path 35 are guided to the packing unit and so on via a hopper (not shown) and packed.

Figure 5:
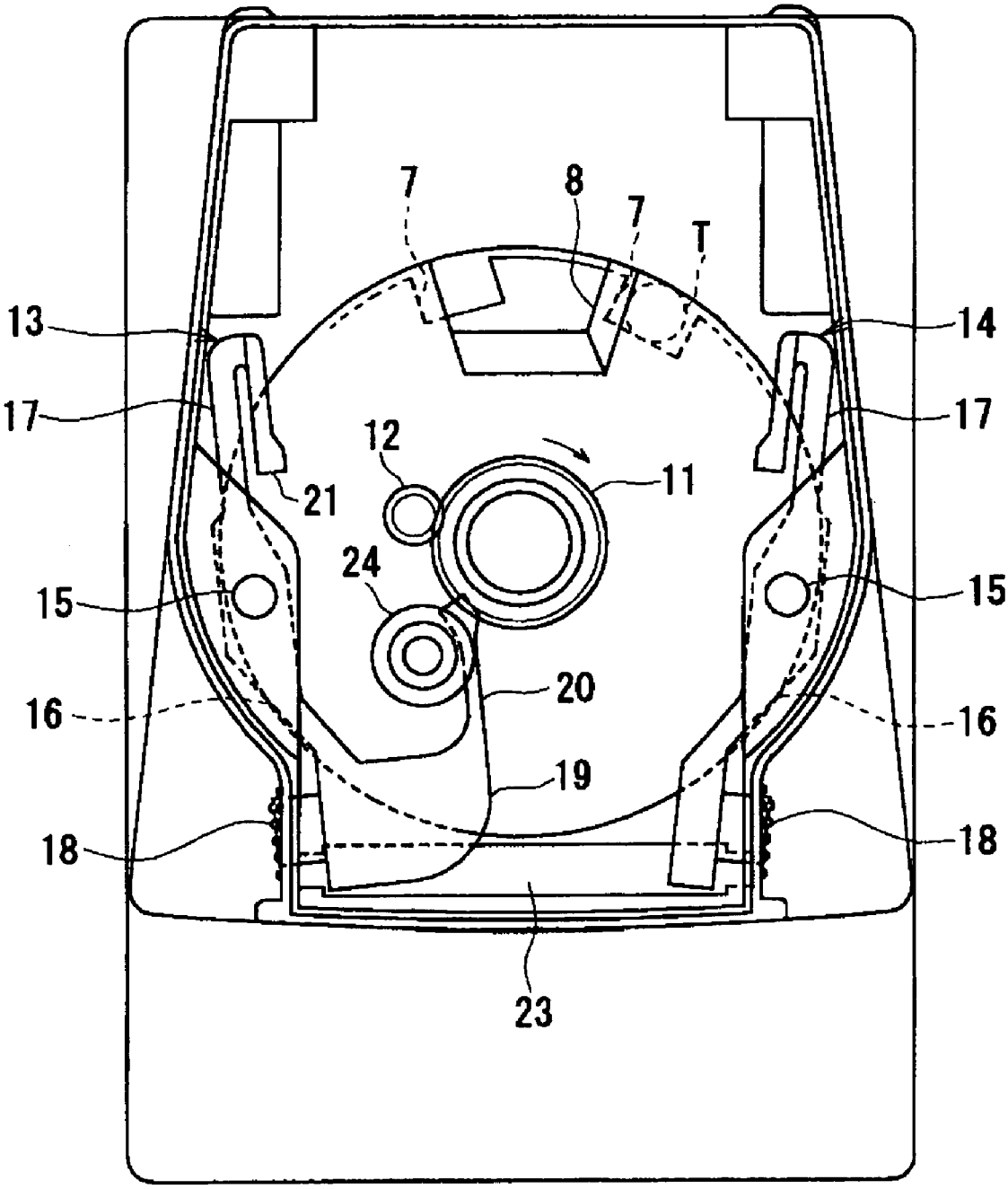
FIG. 5 is a bottom view showing the tablet cassette of FIG. 4 in a pressing state of the press lever.

When the tablet cassette 1 is mounted, as shown in FIG. 4, the engagement claws 21 of the resilient pieces 17 of the first lever 13 and the second lever 14 engage with the engaged portions 31 of the pair of guide portions 30. The extremity of the arm 19 is spaced from the rotor gear 11. In this state, in order to dismount the tablet cassette 1, the press portions 18 of the first lever 13 and the second lever 14 are pressed against the biasing force with thumb and forefinger or middle finger to hold the tablet cassette 1. This causes the first lever 13 and the second lever 14 to pivot around the support shaft 15 as shown in FIG. 5 so that the engagement claws 21 of the resilient pieces 17 of the both levers 13, 14 leave the engaged portions 31 of the guide portions 30 of the mount base 2, enabling the tablet cassette 1 to be removed from the mount base 2 without causing vibration and impact. Pivot of the first lever 13 and the second lever 14 causes the extremity of the arm 19 to engage with the rotor gear 11 and reverse the rotor gear 11 by about one pitch. This causes the rotor to reverse by a distance less than the interval of the pocket portions 8. As a result, the tablet T, the part of which appears in the discharge port 8 when the rotor 6 is stopped, is returned to inside of the discharge port 8. Thus, when the cassette 1 is dismounted, even if vibration and impact are caused, there is no possibility that the tablet T will be discharged.

Figure 8:
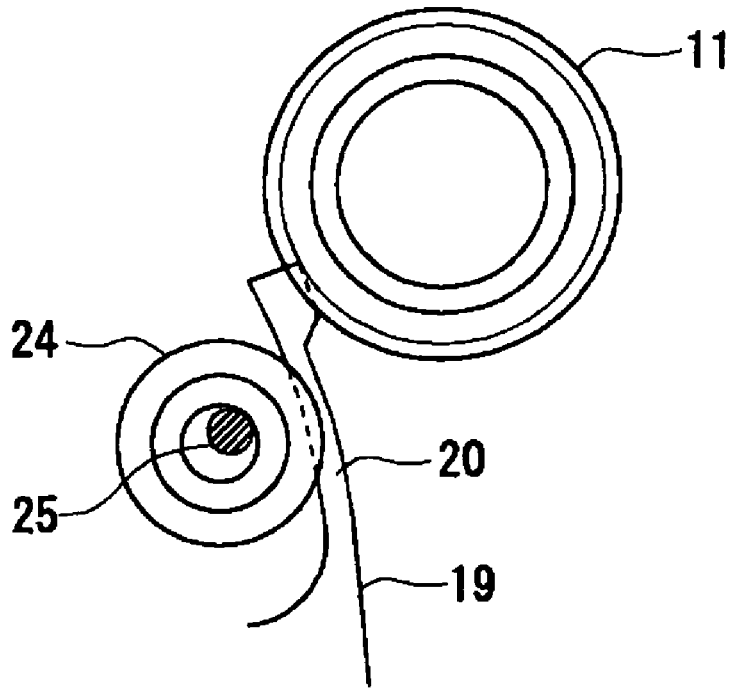
FIG. 8 is a bottom view showing an operation of an arm in a state in which a contact member is away from a rotor gear.
Figure 9:
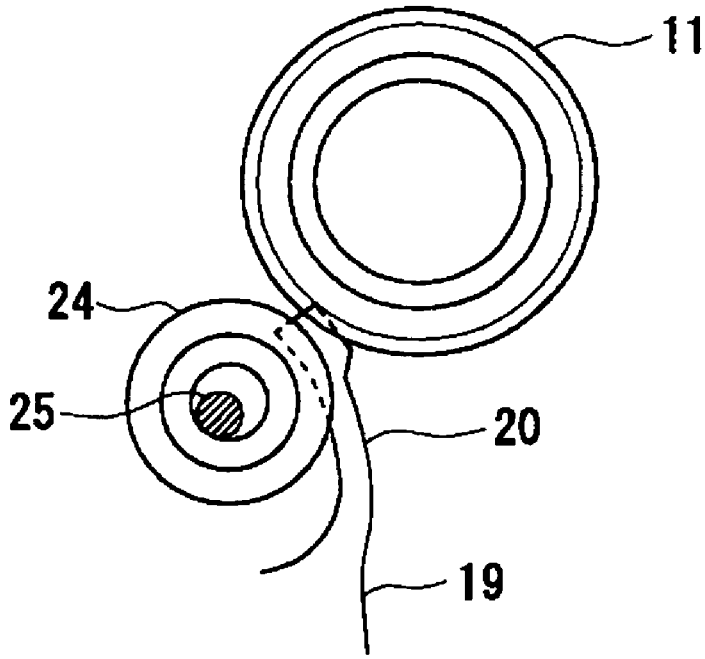
FIG. 9 is a bottom view showing an operation of the arm in a state in which the contact member is close to the rotor gear.

The position of the contact member 24 can be adjusted in accordance with the size of the tablet T contained in the tablet cassette 1. That is to say, in the case of a large tablet T, the adjusting screw 25 of the contact member 24 is loosened to keep the contact member 24 away from the rotor gear 11 as shown in FIG. 8 and then fastened to fix the contact member 24. Thus, the distance between the contact member 24 and the rotor gear 11 becomes wider. As a result, when the press lever 16 of the first lever 13 is pressed, the length of the extremity of the arm 19 that enters the space between the contact member and the rotor gear 11 becomes longer, which allows the rotor gear 11 to rotate by 2 to 3 pitches. By contrast, in the case of a small tablet T, the contact member 24 is brought close to the rotor gear 11 as shown in FIG. 9. Thus, the distance between the contact member 24 and the rotor gear 11 becomes narrower. As a result, when the press lever 16 of the first lever 13 is pressed, the length of the extremity of the arm 19 that enters the space between the contact member and the rotor gear 11 becomes shorter, allowing the rotor gear 11 to rotate only by 1 pitch or less. Even if the press portion 18 is pressed excessively, as the thin-walled portion 20 of the arm 19 is deformed, the extremity of the arm 19 remains engaged with the rotor gear 11 and is prevented from further movement. Therefore, even in the case where the reverse angles of the rotor gear 11, i.e. the movement distance of the arm 19 is reduced, the press portion 18 can be sufficiently pressed, making it easy to operate the press portion 18.

When the dismounted tablet cassette 1 is placed on a shelf or table and the user's hand is released, the first lever 13 and the second lever 14 pivot due to the biasing force of the leaf spring 23 and return to the state as shown in FIG. 4, thereby enabling the rotor 6 to freely rotate. At this time, if the rotor 6 rotates due to falling or such of the tablet cassette 1, the tablet T held in the pocket 7 may appear in the discharge port 8 and drop out of it. However, since the tablet cassette 1 has already been dismounted, problems such as that the tablet T dropping out of the discharge port 8 and admixing with other tablets T will not be caused.

In order to mount the tablet cassette 1 on the mount base 2, in the same manner as when dismounting, the press portions 18 of the first lever 13 and the second lever 14 are pressed against the biasing force with thumb and forefinger or middle finger to hold the tablet cassette 1. This causes the first lever 13 and the second lever 14 to pivot around the support shaft 15 as shown in FIG. 5 so that the extremity of the arm 19 engages with the rotor gear 11 and reverses the rotor gear 11 by about one pitch. As a result, even if a part of the tablet T appeared in the discharge port 8 when the tablet cassette 1 was placed on the shelf or table, the tablet T is returned to the inside of the discharge port 8. Thus, when the cassette 1 is mounted, even if vibration and impact are caused, there is no possibility that the tablet T will be discharged.

Other embodiments will be described hereinafter, though substantially same parts as that of the above first embodiment are identified with the same numerals and the explanation thereof is omitted.

Second Embodiment

Figure 10:
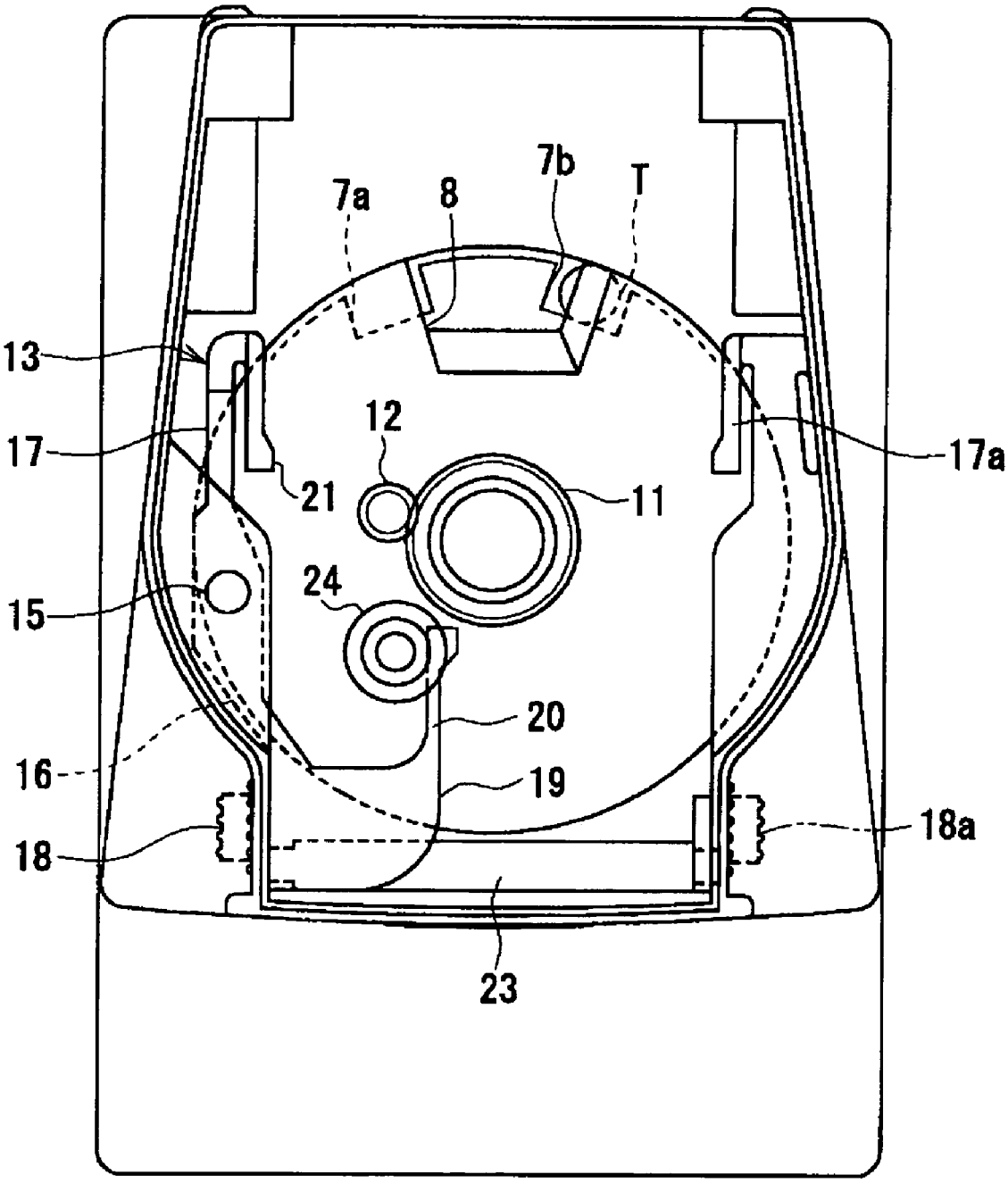
FIG. 10 is a bottom view of a tablet cassette of a second embodiment of the present invention.

FIG. 10 shows a second embodiment of the present invention in which a fixed type of resilient piece 17*a* is provided instead of the second lever 14 of the first embodiment. The first lever and the press member 24 are provided in the same manner as the first embodiment. At a position opposed to the press portion 18 of the press lever 16 of the first lever 13, the press portion 18 as in the first lever 13 is not present but instead a dummy press portion 18*a* which operates in the same manner as the press portion 18 of the first lever 13 may be provided. Operation of the first lever 13 and the press member 24 when dismounting and mounting the tablet cassette 1 is the same as that of the first embodiment and so the description thereof will be omitted.

Third Embodiment

Figure 11:
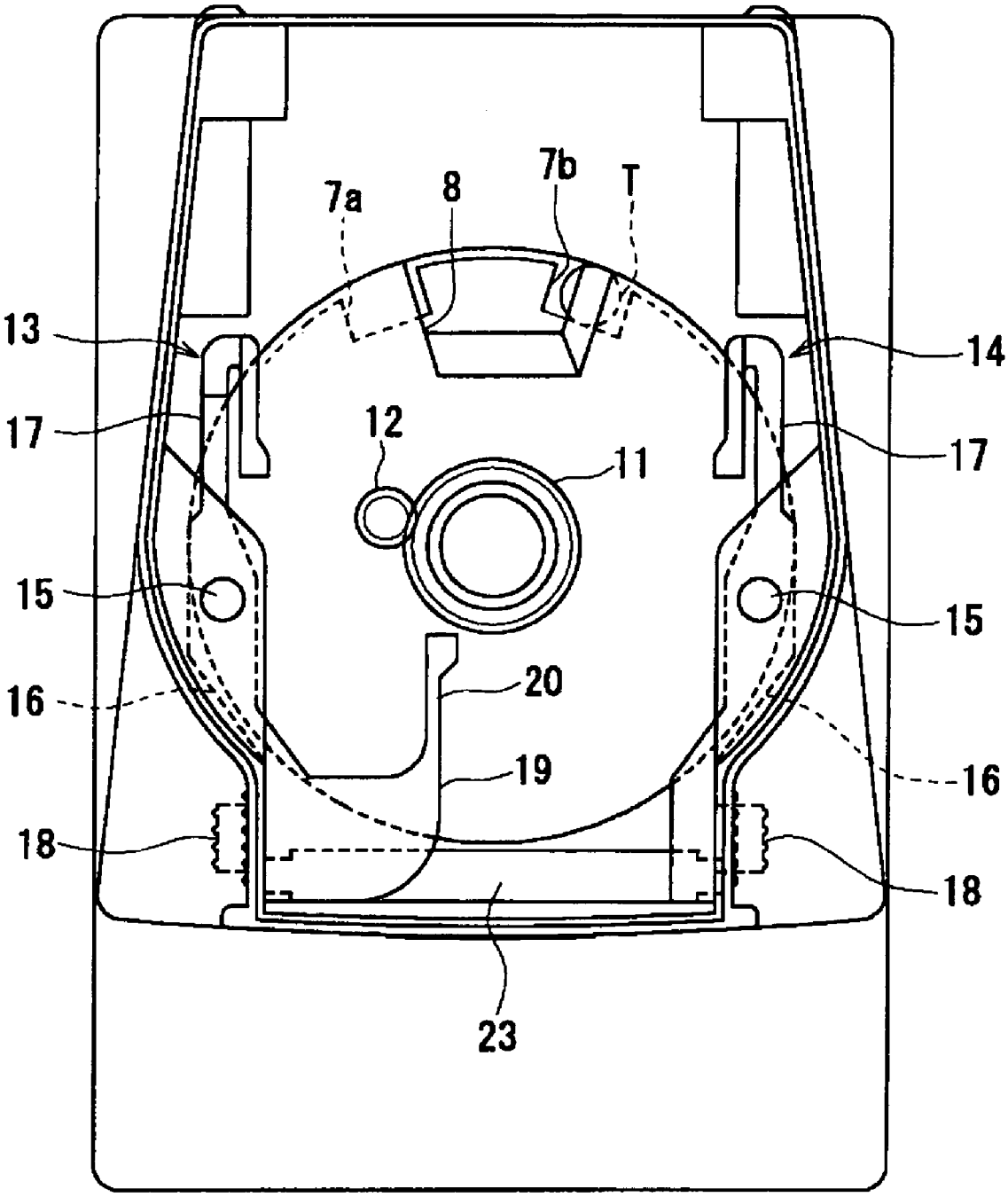
FIG. 11 is a bottom view of a tablet cassette of a third embodiment of the present invention.

FIG. 11 shows a third embodiment of the present invention in which the press member 24 of the first embodiment is removed. The third embodiment can be applied to a case in which the amount of reverse movement of the rotor 6 does not need to be adjusted.

Fourth Embodiment

Figure 12:
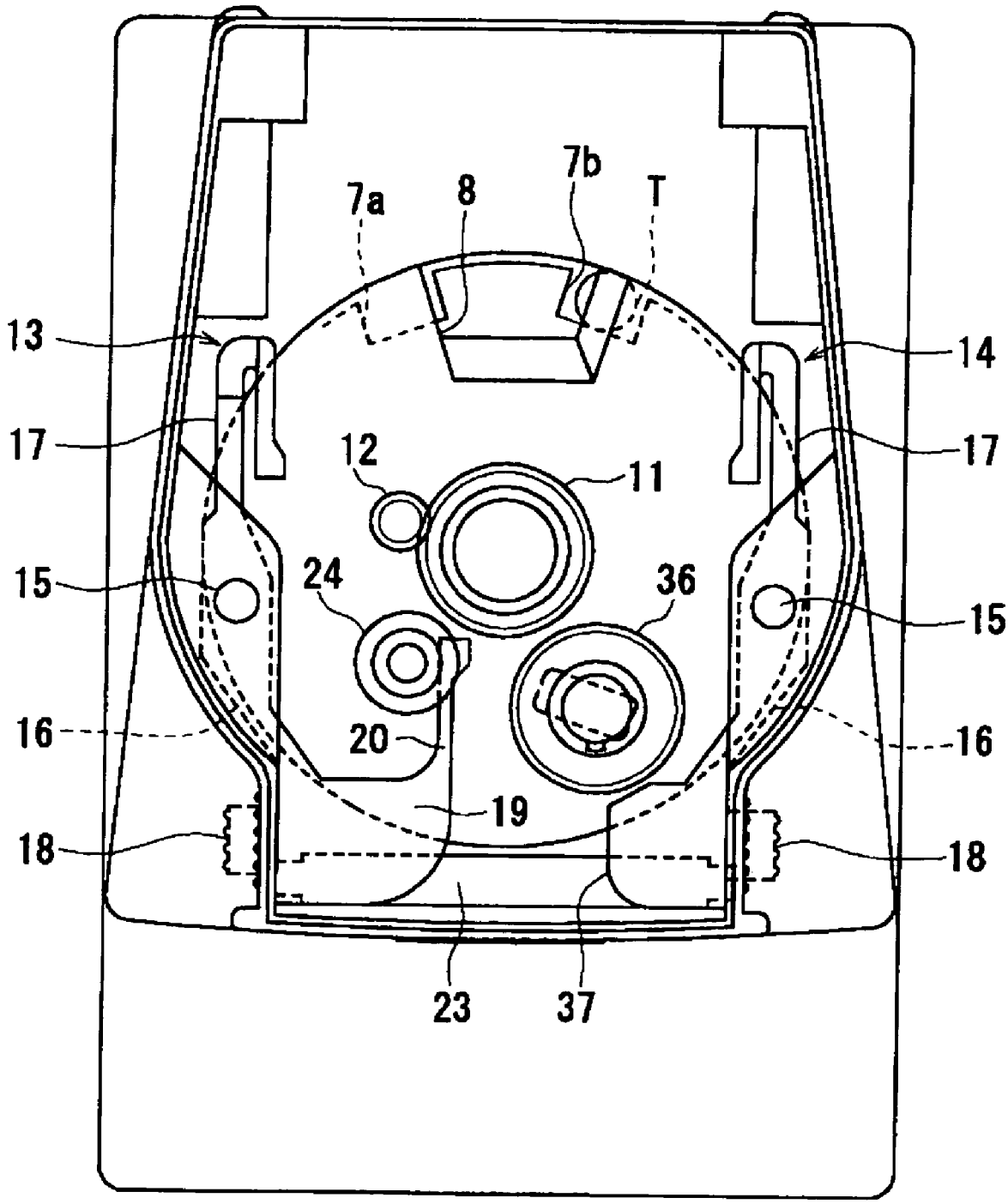
FIG. 12 is a bottom view showing a tablet cassette of a fourth embodiment according to the present invention in a non-pressing state of a press lever.
Figure 13:
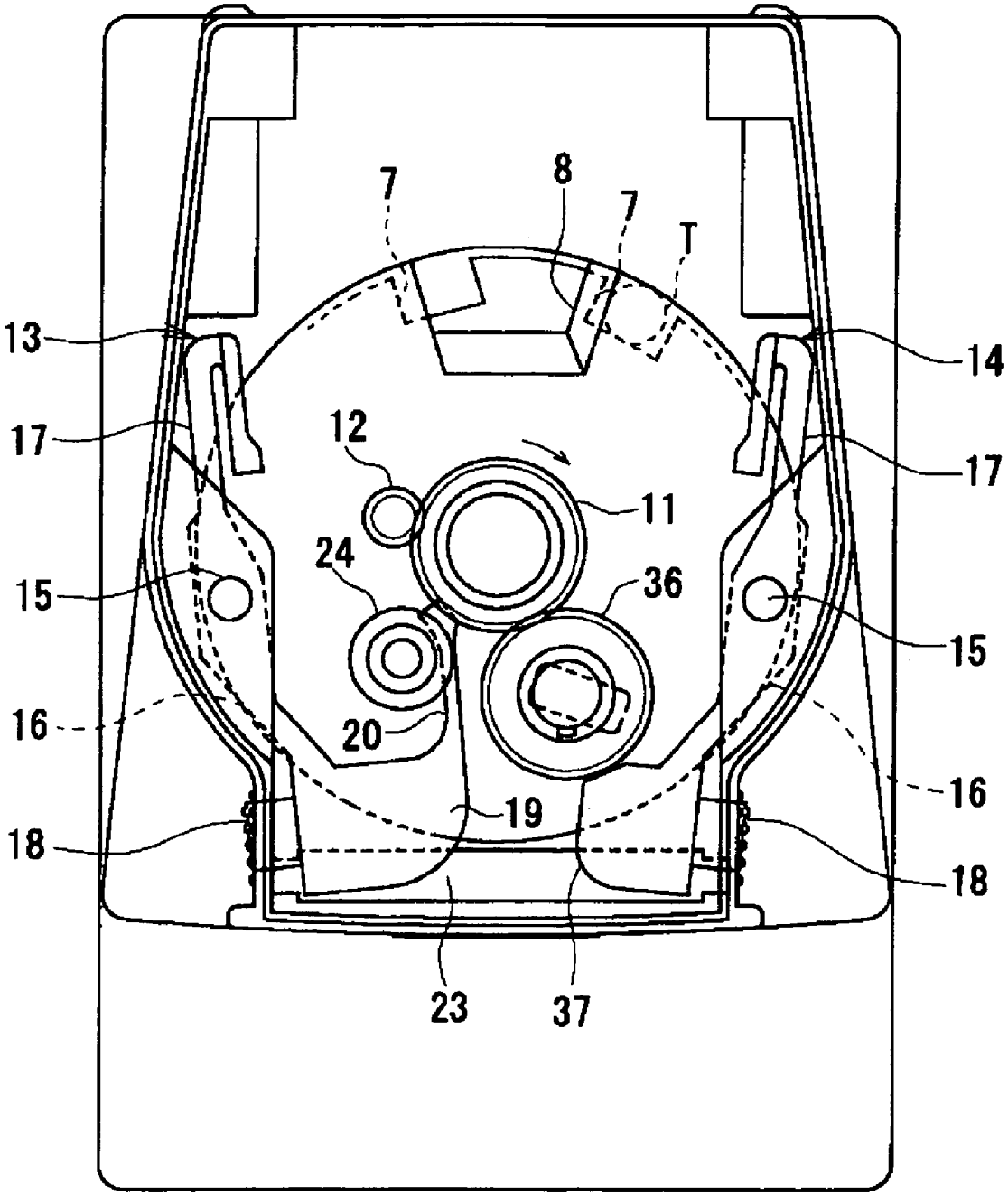
FIG. 13 is a bottom view showing the tablet cassette of FIG. 12 at a pressing state of the press lever.

FIG. 12 shows a fourth embodiment of the present invention in which a rotation restraint gear 36 is provided in the tablet cassette 1 of the first embodiment and a protrusion portion 37 for pressing the rotation restraint gear 36 is provided on the second lever 14 opposite to the press portion 18. The rotation restraint gear 36 is positioned between the second lever 14 and the rotor gear 11 and attached on the bottom of the tablet cassette 1 by means of an attachment screw 39 via a sleeve 38. An O-ring 40 intervenes between the rotation restraint gear 36 and the sleeve 38 to adjust a rotation torque of the rotation restraint gear 36. The rotation restraint gear 36 is movable in a tangential direction of the rotor gear 11 between an operation position where the rotation restraint gear 36 engages with the rotor gear 11 and a retreat position where the rotation restraint gear 36 retreats from the rotor gear 11.

In the fourth embodiment, operation of the first lever 13 when dismounting and mounting the tablet cassette 1 is the same as that of the first embodiment. In the first embodiment, when the user's hand is released from the press portion 17 of the press lever 16, the first lever 13 and the second lever 14 pivot due to the biasing force of the leaf spring 23 to return to the initial position shown in FIG. 1. At this time, the extremity of the arm 19 forwardly rotates the rotor gear 11 when moving away from the teeth of the rotor gear 11, possibly causing the rotor gear 11 to return to the state before the press lever 16 was pressed.

On the other hand, in the fourth embodiment, when the press portion 18 of the second lever 14 as well as the first lever 13 is pressed, the protrusion portion 37 of the second lever 14 presses the rotation restraint gear 36. Thus, the rotation restraint gear 36 moves from the retreat position to the operation position to engage with the rotor gear 11. In this state, the rotor gear 11 never rotates unless a torque more than a predetermined level is exerted. Due to torque exerted on the rotor gear 11 when the extremity of the arm 19 of the first lever 13 engages with and presses the teeth of the rotor gear 11, the rotor gear 11 can be rotated. On the other hand, torque exerted on the rotor gear 11 when the extremity of the arm 19 of the first lever 13 moves away from the teeth of the rotor gear 11, the rotor gear 11 cannot be rotated. Therefore, there is no possibility that the extremity of the arm 19 forwardly rotates the rotor gear 11 when moving away from the teeth of the rotor gear 11, thereby causing the rotor gear 11 to return to the state before pressing the press lever 16.

Figure 14:
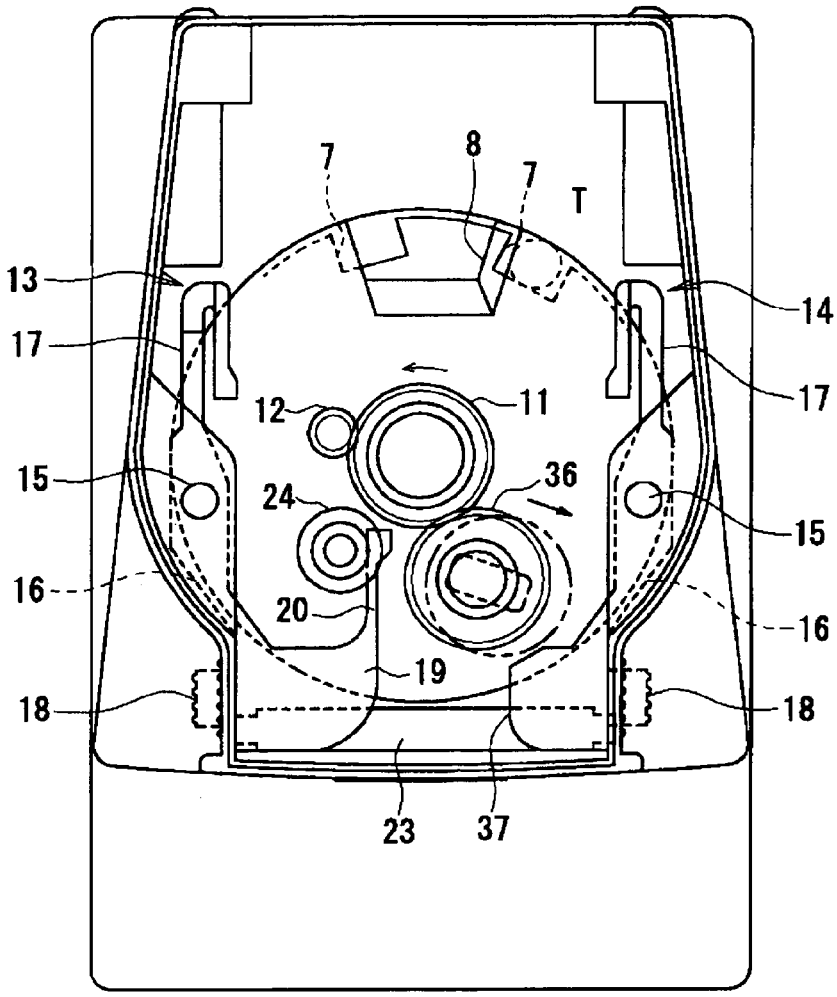
FIG. 14 is a bottom view showing the tablet cassette of FIG. 12 at a non-pressing state of the press lever.
Figure 15:
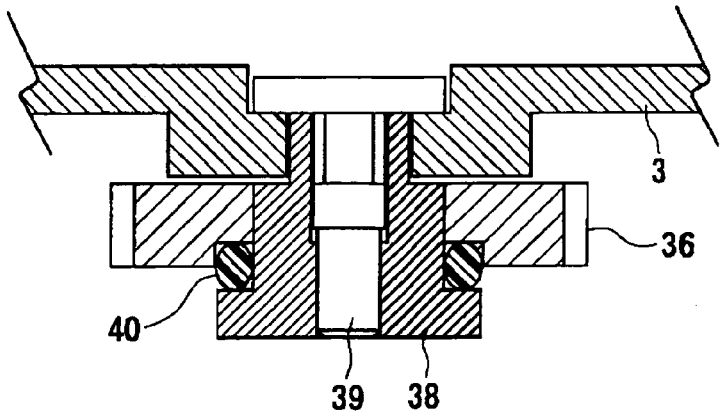
FIG. 15 is a sectional view of a rotation restraint gear.

When the tablet cassette 1 is dismounted and the user's hand is released from the press portion 18 of the first lever 13 and the second lever 14, the protrusion portion 37 of the second lever 14 moves away from the rotation restraint gear 36 while the rotation restraint gear 36 remains engaged with the rotor gear 11. However, if a force having a torque more than a predetermined level is exerted on the rotor gear 11 in a direction of forward rotation due to vibration or impact, a turning force transmitted from the teeth of the rotor gear 11 to the teeth of the rotation restraint gear 36 causes the rotation restraint gear 36 to move away from the rotor gear 11 in a tangential direction of the rotor gear 11, i.e. in a direction indicated by the arrow shown in two dots chain line in FIG. 14.

Operation of the rotation restraint gear 36 when mounting the tablet cassette 1 on the mount base 2 is the same as that when dismounting. So, there is no possibility that the extremity of the arm 19 forwardly rotates the rotor gear 11 when moving away from the teeth of the rotor gear 11, causing the rotor gear 11 to return to the state before pressing the press lever 16. Further, even if the user's hand is released from the press portions 18 of the first lever 13 and the second lever 14, the rotation restraint gear 36 remains engaged with the rotor gear 11. However, when the motor 32 is driven in order to discharge the tablet T and a force is exerted on the rotor gear 11 in a direction of forward rotation via the drive gear 34 and the intermediate gear 12, a turning force transmitted from the teeth of the rotor gear 11 to the teeth of the rotation restraint gear 36 causes the rotation restraint gear 36 to move away from the rotor gear 11 in a tangential direction of the rotor gear 11, i.e. in a direction indicated by the arrow shown in two dots chain line in FIG. 14, thereby allowing the normal discharging operation of the tablets T to be conducted.

In the above embodiments, the arm 19 of the press lever 16 of the first lever 13 is formed with the thin-walled portion 20 as a flexible portion integrally with the arm 19, though the arm 19 may be wholly constructed by a leaf spring; the extremity of the arm 19 may be provided with a leaf spring; or the extremity or intermediate portion of the arm 19 may be attached with a torsion spring.

The invention claimed is:

1. A tablet cassette for containing a number of tablets, the tablet cassette comprising:

a rotor having a plurality of pocket portions for holding the tablets so that, when the tablet cassette is mounted on a mount base, rotation of the rotor causes the tablets held in the pocket portions to be discharged though a discharge port;

a press member which can be pressed when the tablet cassette is held by a user to permit the tablet cassette to be mounted on the mount base; and a rotor reversing member for reversing the rotor by a predetermined quantity in conjunction with the pressing of the press member.

2. The tablet cassette as in claim 1, wherein the press member is a press lever that is rotatably provided on the tablet cassette.

3. The tablet cassette as in claim 2, wherein the press member is rotatably supported by a support shaft and comprises a resilient piece extending from the support shaft to the opposite side relative to the press lever, and the resilient piece comprises an engagement claw for engaging with and disengaging from an engaged portion of a guide rail provided on the mount base.

4. The tablet cassette as in claim 1, wherein the press member comprises a pair of members which can be pressed at the same time when the tablet cassette is held.

5. The tablet cassette as in claim 4, wherein the rotor reversing member is provided on any one of the pair of press members.

6. The tablet cassette as in claim 1, further comprising a biasing member for biasing the press member in a non-pressing direction.

7. The tablet cassette as in claim 1, wherein the rotor reversing member is an arm extending from the press member, the extremity of the arm is obliquely opposed to teeth of a rotor gear fixed on a shaft of the rotor which protrudes from the bottom of the tablet cassette.

8. The tablet cassette as in claim 7, further comprising a contact member provided in the vicinity of the rotor gear, wherein the position of the contact member is adjustable so that the distance to the rotor gear can be adjusted, and wherein a portion of the arm close to the extremity of the arm comes into contact with the contact member so that the extremity of the arm can enter into a space between the contact member and the rotor gear when the press member is pressed.

9. The tablet cassette as in claim 8, wherein a flexible portion is provided in at least one part of the arm.

10. The tablet cassette as in claim 7, further comprising a rotation restraint gear which moves in response to pressing of the press member and engages with the rotor gear to restrain the rotor gear from rotating at a torque less than a predetermined level.

11. The tablet cassette as in claim 10, wherein the rotation restraint gear is movable in a tangential direction of the rotor gear.

* * * * *